US005716115A

United States Patent [19]

Anoszko

[11] Patent Number: 5,716,115

[45] Date of Patent: Feb. 10, 1998

[54] DOOR ASSEMBLY FOR AIR FILTER HOUSING

[75] Inventor: Thomas J. Anoszko, Oregon, Wis.

[73] Assignee: Research Products Corporation, Madison, Wis.

[21] Appl. No.: 643,624

[22] Filed: May 6, 1996

[51] Int. Cl.[6] ..... A47B 47/00

[52] U.S. Cl. ..... 312/265.6; 49/463; 49/466; 220/315; 220/318; 312/296

[58] Field of Search ..... 312/263, 265.5, 312/265.6, 296, 319.1, 223.2, 223.1; 49/463, 466, 465; 220/315, 318, 260

[56] References Cited

U.S. PATENT DOCUMENTS

| | | | |
|---|---|---|---|
| 2,192,862 | 3/1940 | Eagley | 312/265.6 X |
| 3,325,237 | 6/1967 | Dirk et al. | 312/296 |
| 3,792,551 | 2/1974 | Hallas | 49/463 |
| 4,739,955 | 4/1988 | Aquino et al. | 49/465 X |
| 4,776,484 | 10/1988 | Hansen | 49/463 X |
| 5,145,243 | 9/1992 | Liu | 312/265.1 |
| 5,165,770 | 11/1992 | Hahn | 312/265.6 X |
| 5,423,605 | 6/1995 | Liu | 312/265.6 |

FOREIGN PATENT DOCUMENTS

| | | | |
|---|---|---|---|
| 2396862 | 3/1979 | France | 49/463 |
| 5003993 | 1/1993 | Japan | 312/265.5 |
| 740652 | 11/1955 | United Kingdom | 312/296 |

*Primary Examiner*—Peter M. Cuomo
*Assistant Examiner*—Janet M. Wilkins
*Attorney, Agent, or Firm*—Andrus, Sceales, Starke & Sawall

[57] ABSTRACT

A selectively removable door assembly is provided for completing an air filter housing having a series of interconnected walls for enclosing an air filter, certain of the walls being formed with retaining pockets. The door assembly comprises a door having a main portion and opposed end portions. Each of the end portions is provided with a ridge engageable with a respective one of the pockets on the walls for retaining the door on the housing. At least one of the ridges is resiliently and slidably mounted on the door in a biased snap-fit in its respective pocket such that pushing against the bias of the resiliently mounted ridge will permit movement of the other ridge out of its respective pocket and allow the removal of the door to access the air filter.

9 Claims, 3 Drawing Sheets

DOOR ASSEMBLY FOR AIR FILTER HOUSING

FIELD OF THE INVENTION

This invention relates broadly to an air filter housing construction and, more particularly, pertains to a removable door assembly for an air filter housing used to enclose the air filter.

BACKGROUND OF THE INVENTION

It is a common practice in air cleaners designed for heating and air conditioning systems to employ a removable plastic door which completes the interconnected side and end walls of a metal housing, and permits access to the air filter for replacement and service. In the prior art air cleaners, a pair of upper and lower retainers are secured by multiple fastener assemblies to the opposed end walls of the metal housing. Each retainer is integrally formed with a depending, flexible boss which together with a portion of the housing creates a recess for retaining a fixed projection on the plastic door. Pulling the retainer away from the fixed projection on the end of the door allows the door to be removed from the housing. The inside of the door is provided with insulation which extends along the length of the door to protect the door from the heat in the associated heating system and prevent air bypass.

Employing the prior art door assembly requires the manufacturer to stock retainers and a set of screw and plastic screw cap fasteners in addition to the door. Installation becomes involved because of the number of fasteners and their mounting location. The design requires the assembler to reach into the air filter housing to tighten the screws which creates problems with obstructed access and reduced visibility. In addition, the plastic screw caps and the plastic door could be exposed to the flame from the heating system. This could result in melting the plastic components such that the door could fall away from the housing.

Accordingly, it is desirable to provide an improved door assembly for an air filter housing which offers advantages over the prior art including ease of assembly, parts reduction, and a more efficient fire break. Such door assembly should be simple and reliable in operation break. Such door assembly should be simple and reliable in operation and allow quick, convenient access for replacing or servicing the air filter in the housing.

SUMMARY OF THE INVENTION

The present invention advantageously provides an aesthetically pleasing air filter housing door assembly particularly useful in residential heating and air conditioning systems for sealing air leakage and creating a fire break in the duct work of the system. The present invention greatly simplifies the existing door assembly by offering a parts reduction which simplifies assembly and inventory requirements.

In one aspect of the invention, a selectively removable door assembly is provided for completing an air filter housing having a series of interconnected walls for enclosing an air filter. Certain of the walls are formed with retaining pockets therein. A door has a main portion and opposed end portions, each of the end portions being provided with a ridge engageable with a respective one of the pockets on the walls for retaining the door on the housing. At least one of the ridges is resiliently and movably mounted relative to the door in a biased, snap-fit in its respective pocket such that pushing against the bias of the resiliently and movably mounted ridge will permit movement of the other ridge out of its respective pocket and allow the removal of the door to access the air filter.

In another aspect of the invention, an air filter housing having a series of interconnected walls for partially enclosing an air filter is improved by a removable door assembly cooperable with the walls to complete the housing and fully enclose the air filter. The door assembly includes the door having a length, a width, and end portions engageable with the wall so as to retain the door in place. The ridge arrangement is slidably and resiliently retained on one end of the door and is normally biased into engagement with one of the walls. The door has an inside surface to which the ridge assembly is mounted and the inside surface is provided with a series of parallel, spaced apart support ledges extending substantially across the width thereof. A fiberglass seal extends along the entire length of the door and is adhesively engageable with the ledges.

In yet another aspect of the invention, there is contemplated a door assembly for an air filter housing having a pair of parallel, opposed end walls having first ends and second ends and a side wall interconnecting the first ends of the end walls. The second ends of the end walls are formed with retaining pockets. A door has a main portion and opposed end portions, one of the end portions having a first ridge integral with the door and engageable with respect to one of the pockets. The other of the end portions includes a second ridge slidably and resiliently mounted on the door and engageable with a respective one of the pockets. The first ridge and the second ridge are cooperable with the pockets for retaining the door in the housing and completing the housing. The main portion of the door includes a pair of spaced, slightly diverging brackets. The second ridge includes a flexible, spring-biased beam extending generally parallel to the second ridge and in spaced relationship thereto. The beam includes a pair of upwardly projecting, slightly outwardly diverging prongs, an upper portion of each of the prongs having a tang slidable within each of the brackets and engageable in a snap-fit over a top portion of each of the brackets. Pushing against the other of the end portions of the door will cause the beam to flex, and the second ridge to slide relative to the door such that the first ridge will be dislodged from its respective pocket, enabling the door to be removed.

DETAILED DESCRIPTION OF THE PREFERRED EMBODIMENT

Figure 1:
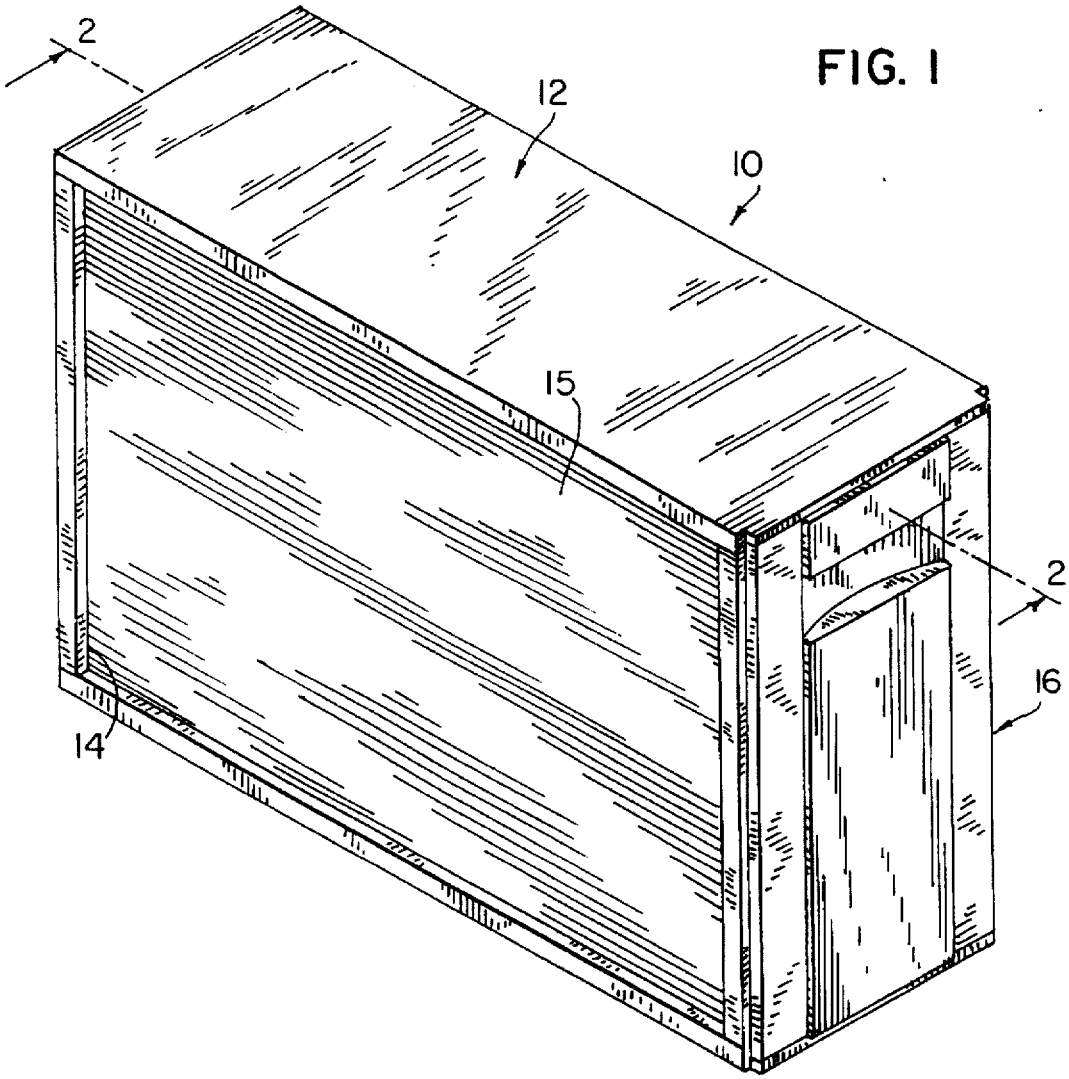
FIG. 1 is a perspective view of an air filter constructed according to the present invention.
Figure 2:
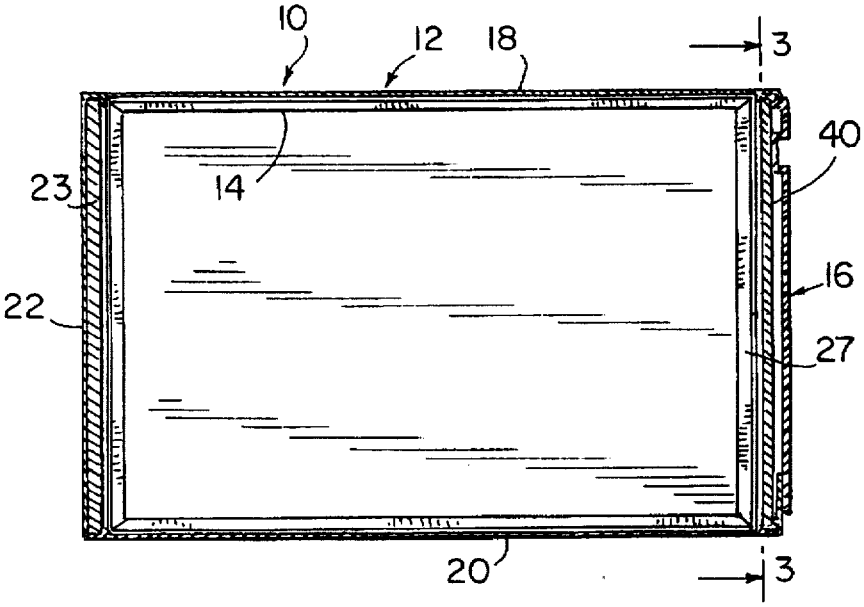
FIG. 2 is a sectional view taken on line 2—2 of FIG. 1.
Figure 3:
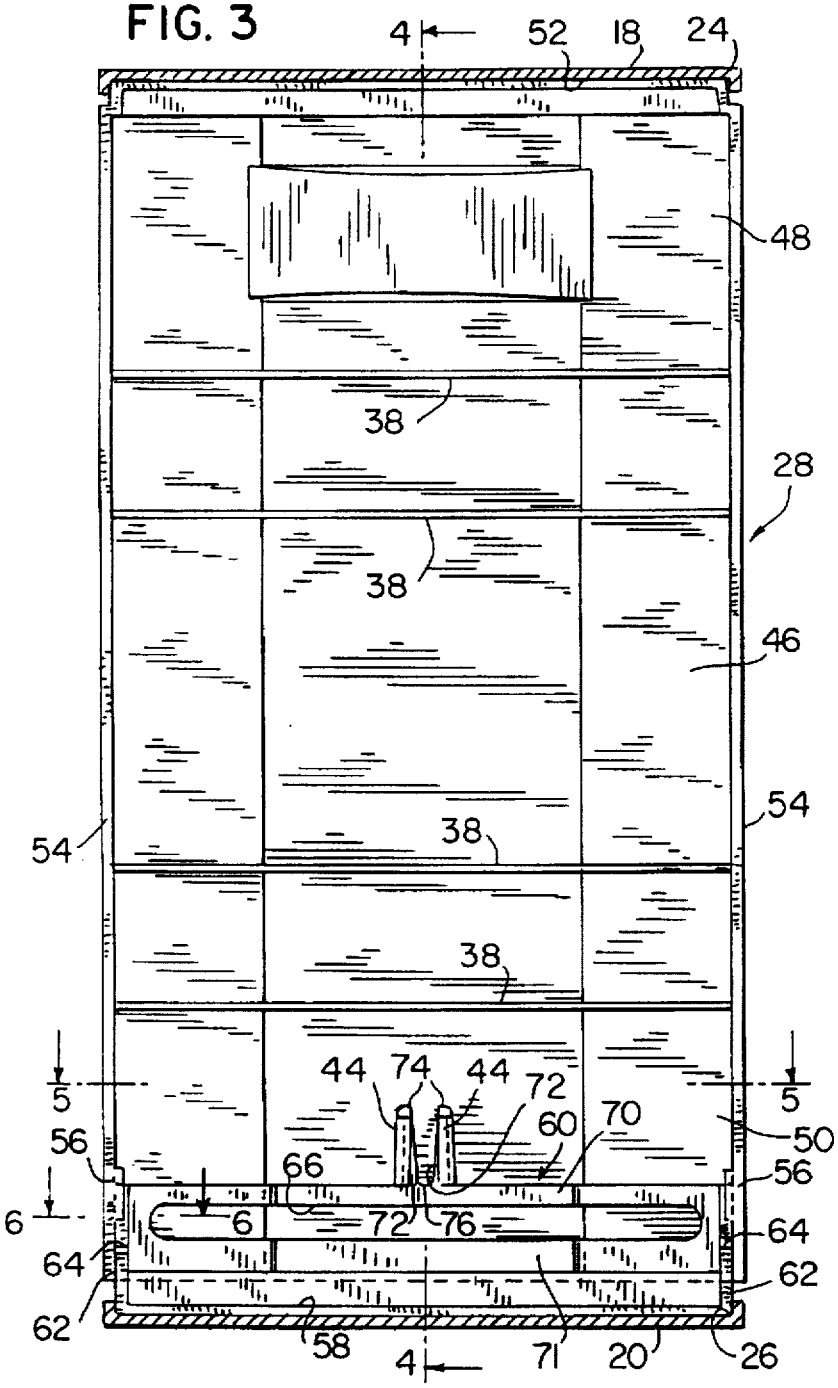
FIG. 3 is a sectional view taken on line 3—3 of FIG. 2.

As shown in FIG. 1, an air filter 10 includes a metal housing 12 in which an air filter framework 14 is slidably disposed. Filter framework 14 holds replaceable pleated filter media 15. In operation, the housing 12 of the air filter 10 is positioned in the ventilation duct of a heating or air conditioning system of a home or other structure. Air is drawn across the filter media 15 to extract undesirable particulate matter from the air. Periodic maintenance of the air filter 10 requires replacement of the filter media 15 and this is performed by sliding the filter framework 14 out from the housing 12.

Metal housing 12 is comprised of a series of interconnected walls for partially enclosing the air filter 10, and is normally completed by a removable door assembly 16 which allows access to the air filter 10 for replacement and service. Housing typically includes opposed end walls 18, 20, each having one end joined perpendicularly and integrally to a side wall 22. A first fiberglass seal 23 is normally provided against the sidewall 22 to prevent air leakage as is well known. Each of the end walls 18, 20 has another end which is formed with a generally rectangular pocket 24, 26 for receiving the door assembly 16. Housing 12 also includes a pair of framework members 27 which are joined perpendicularly to the ends of the end walls 18, 20 formed with the pockets 24, 26.

Figure 5:
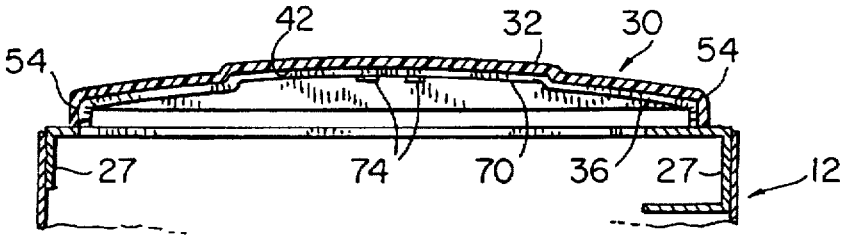
FIG. 5 is a sectional view taken on line 5—5 of FIG. 3.
Figure 6:
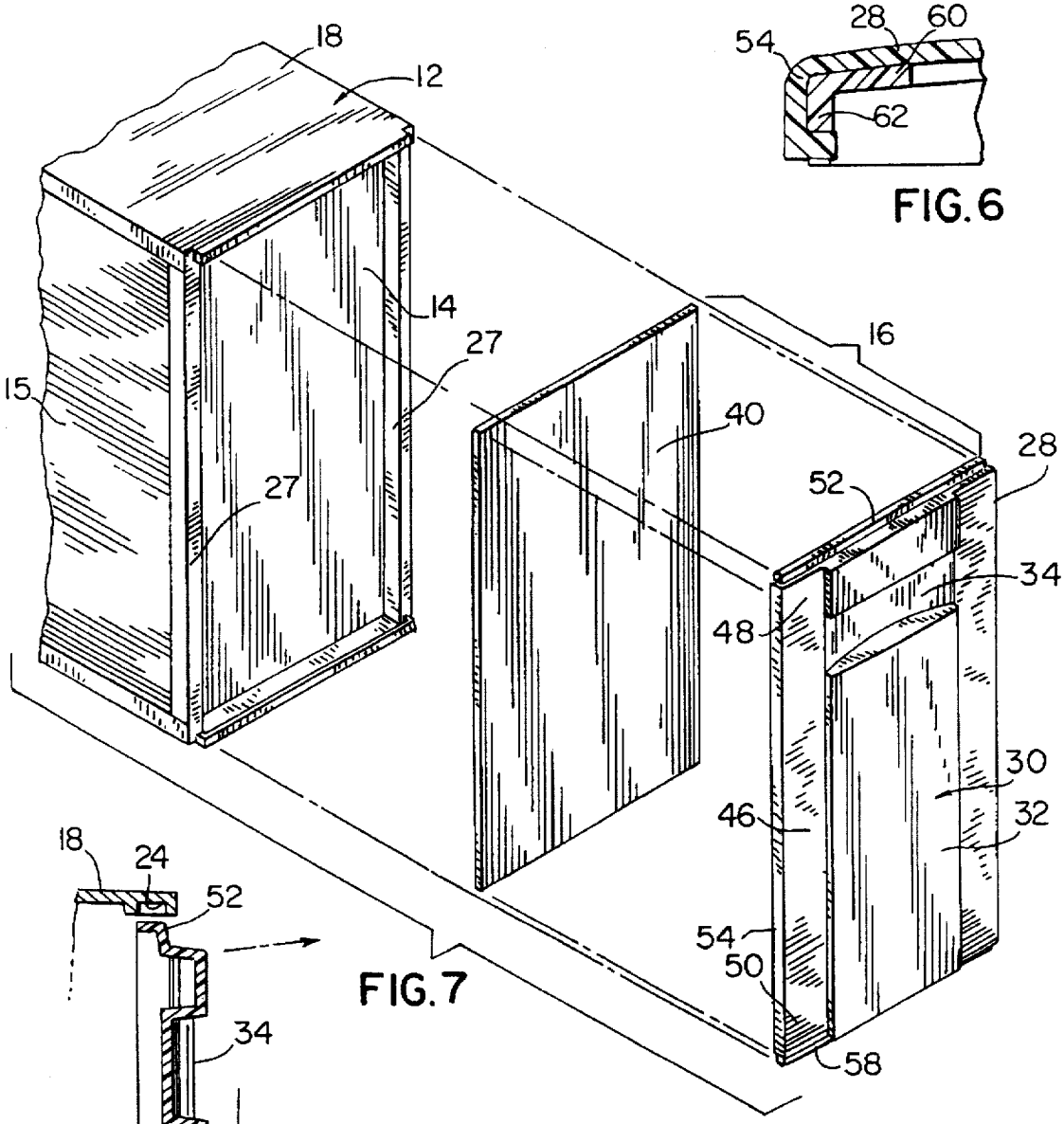
FIG. 6 is a sectional view taken on line 6—6 of FIG. 3.
Figure 6:
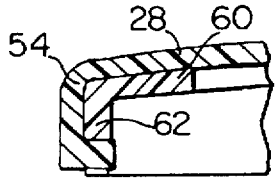
Figure 7:
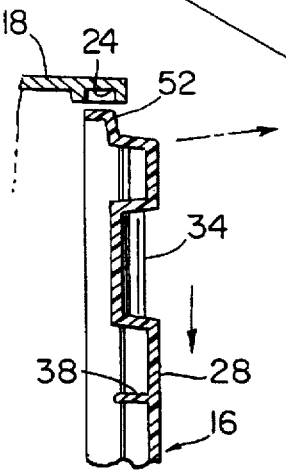
FIG. 7 is a perspective, exploded view of a door assembly for the air filter shown in FIG. 1.

According to the invention, the door assembly 16 is cooperable with the end walls 18, 20 and members 27 and functions to fully enclose the filter media 15 when in assembled form. The door assembly 16 comprises a plastic door 28, typically injection molded from polystyrene, and has a length, width and ends engageable with the walls 18, 20 to retain the door 28 in place. As seen in FIGS. 5 and 7, the door 28 has a slightly convexly bowed outer surface 30 having a slightly raised medial portion 32 running longitudinally thereof and is recessed along its upper end to define a handle 34. The door 28 also has a slightly concavely bowed inside surface 36 formed with a series of parallel, horizontally disposed ledges 38 extending substantially across the width of the door 28. The ledges 38 provide a separate retainer structure for a second fiberglass seal 40 to be further described, and also lend further reinforcement to the door structure. The inside surface 36 includes a shallow mouth 42 formed by the raised medial portion 32 of the outside surface 30 and extends transverse to the ledges 38. Centrally located in the lower portion of the mouth 42 is a pair of slightly outwardly diverging, L-shaped mounting brackets 44 for uniquely retaining the door assembly 16 in a manner to be described hereafter.

The door assembly 16 further includes a main portion 46 and opposed end portions 48, 50. In the preferred embodiment, the upper end portion 48 is integrally formed with a generally rectangular first ridge 52 which extends substantially across the width of the door 28 and is adapted to slidably fit into the pocket 24 on end wall 18. The ridge 52 is recessed from the outer surface 30 to create an interface which seats against the end wall 18 on housing 12. The inside surface 36 of the door 28 is integrally molded with side portions 54 which extend downwardly from the first ridge 52 along the length of the door 28 and include elongated ears 56 joined generally orthogonally to the side portions 54. The lower end portion 50 of the door 28 also includes a generally rectangular second ridge 58 which is formed at the bottom of a separately molded, one piece plastic component 60 adapted to be slidably and resiliently mounted on the door 28. The second ridge 58 includes side rails 62 provided with stepped stop walls 64, and has an upper portion specially molded and formed with a large slot 66 to create a flexible, spring-biased beam 68 spaced therefrom. The upper portion is also formed with a pair of recessed tongues 70, 71 which are adapted to slide in the mouth 42 defined on the inside of the door 28. The beam 68 is provided with a pair of upwardly projecting, slightly outwardly diverging, resilient prongs 72, an upper portion of each prong 72 having a tang 74 slidable within one of the L-shaped brackets 44 and engageable in a snap-fit with the top of the bracket 44.

Figure 8:
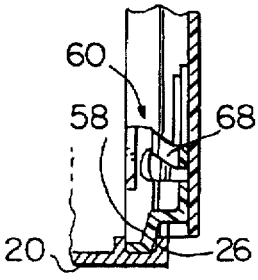
FIG. 8 is a fragmentary, sectional view of the door assembly being removed from the air filter.
Figure 9:
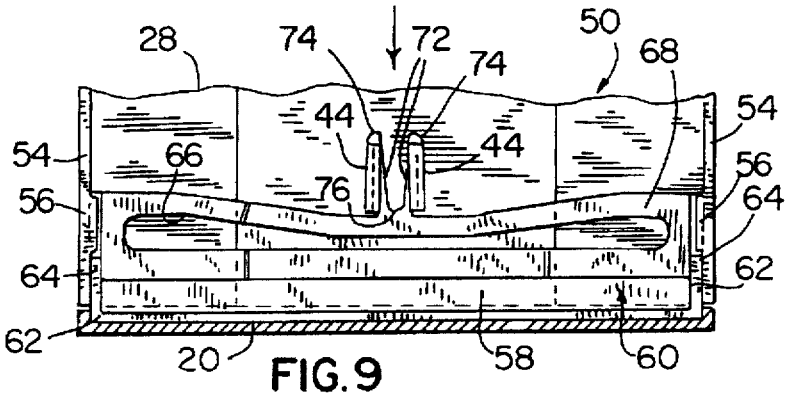
FIG. 9 is a fragmentary, sectional view of the bottom of the door assembly being removed from the air filter.

To assemble door 28 with component 60, the tangs 74 are positioned at the bottom of the brackets 44, the side rails 62 integrally connected with the second ridge 58 are aligned to slide against the side portions 54 of the door 28, and the tongues 70, 71 on the upper portion of component 60 are aligned to slide within the mouth 42 on the inside of the door 28. One simply pushes the component 60 upwardly until the tangs 74 on the prongs 72 snap in place over the brackets 44. As illustrated in FIGS. 8 and 9, pushing down on the door 28 will cause the ends of the beam 68 to flex upwardly about the base 76 of the prongs 72 and enable the door 28 to slide relative to the second ridge 58 until the ears 56 engage the stop walls 64. The tongues 70, 71 on the second ridge component 60 are also slidable within the mouth 42 and the door 28. The mouth 42 and side portions 54 thus form guide tracks for ensuring smooth, relative movement between the door 28 and the second ridge 58.

Figure 4:
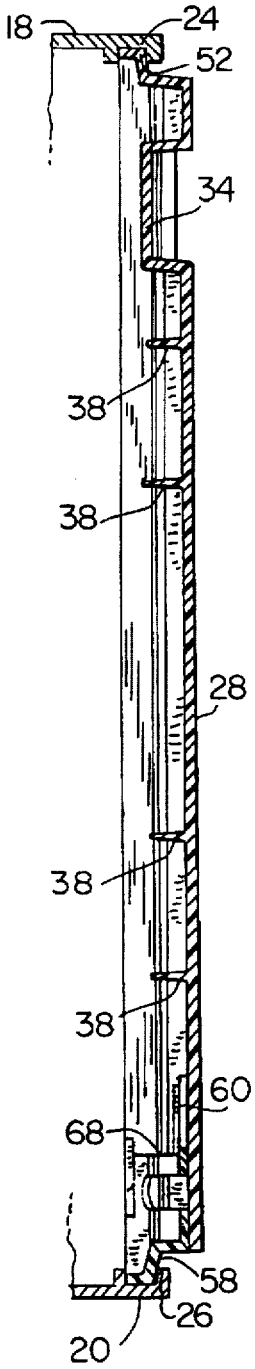
FIG. 4 is a sectional view taken on line 4—4 of FIG. 3.

To install the door assembly 16 on housing 12, one simply positions the second ridge 58 in its mating pocket 26 on the end wall 20 and, using handle 34, applies a downward force to move the door 28 and first ridge 52 integral therewith in a downward direction so that the first ridge 52 can be disposed in alignment with the corresponding pocket 24 on the other end wall 18. Releasing downward pressure on the handle 34 will allow the door 28 to spring upwardly due to the release of the energy from the biased beam 68. First ridge 52 then engages in pocket 24, and second ridge 58 remains engaged in a snap-fit with pocket 26 (FIG. 4). To remove the door assembly 16, as shown in FIG. 8, one simply pushes the handle 34 in door 28 downwardly relative to the component 60 to dislodge the first ridge 52 from its pocket 24. The door 28 is then tilted forwardly pulling second ridge 58 from its pocket 26 to allow access to housing 12.

A further feature of the invention resides in the fiberglass seal 40 which is confined by the first ridge 52, the second ridge 58, and the side portions 54, and covers essentially the entire inside surface 36 of the door 28. Fiberglass seal 40 is pressed into the voids created between the ledges 38 and is adhesively bonded to the ledges 38 to hold the seal 40 in place. The fiberglass seal 40 extends substantially along the entire length and across the entire width of the door 28 creating a seal to prevent air leakage. The seal 40 also shields the door 28 from the intense heat of the system upstream so that melting will not occur and the door 28 will be retained with respect to the housing 12.

While the invention has been described with reference to a preferred embodiment, those skilled in the art will appreciate that certain substitutions, alterations and omissions may be made without departing from the spirit thereof. Accordingly, the foregoing description is meant to be exemplary only, and should not be deemed limitative on the scope of the invention set forth with following claims.

I claim:

1. A selectively removable door assembly on an air filter housing having a series of interconnected walls for enclosing an air filter, certain of the walls being formed with retaining pockets therein, the door assembly comprising:

a door having a main portion and opposed end portions, each of said end portions provided with a ridge engageable with a respective one of said pockets on said walls for retaining said door on said housing, at least one of said ridges being resiliently and slidably mounted relative to said door in a biased, snap-fit in its respective pocket such that pushing against the bias of said resiliently and movably mounted ridge will permit movement of said other ridge out of its respective pocket and allow the removal of said door to access said air filter, said door having a pair of L-shaped brackets and a flexible resilient beam spaced from said resiliently and slidably mounted ridge and mounted on said door, said beam including a pair of upwardly projecting prongs engageable with said L-shaped brackets.

2. The door assembly of claim 1, wherein said door includes a fiberglass seal retained on an inner side thereof.

3. In an air filter housing having a series of interconnected walls for partially enclosing an air filter, the improvement residing in:

a removable door assembly cooperable with said walls to complete said housing and fully enclose said air filter, said door assembly including a door having a length, a width and end portions engageable with said walls so as to retain said door in place, and a ridge arrangement slidably and resiliently retained on one end of said door, said ridge arrangement normally biased into engagement with one of said walls, wherein said door has an inside surface to which said ridge arrangement is mounted, said inside surface being provided with a series of parallel, spaced apart support ledges extending substantially across the width thereof, and wherein said door includes a fiberglass seal which extends substantially along the entire length and across the entire width of said door and which is adhesively bondable to said ledges.

4. The improvement of claim 3, wherein said door has an outside surface provided with a handle operable to exert a force against said ridge arrangement.

5. The improvement of claim 3, wherein said ridge arrangement comprises a ridge and a biased beam connected to said ridge in spaced relationship therewith.

6. A door assembly for an air filter housing having a pair of parallel, opposed end walls having first ends and second ends, and a side wall interconnecting the first ends of the end walls, the second ends of the end walls being formed with retaining pockets, the door assembly comprising:

a door having a main portion and opposed end portions, one of the end portions having a first ridge integral with said door and engageable with a respective one of said pockets, the other of said end portions including a second ridge slidably and resiliently mounted on said door and engageable with a respective one of said pockets, said first ridge and said second ridge cooperable with said pockets for retaining said door on said housing and completing said housing, the main portion of said door including a pair of spaced, slightly diverging brackets, said second ridge including a flexible, spring-biased beam spaced therefrom, said beam including a pair of upwardly projecting, slightly outwardly diverging prongs, an upper portion of each of said prongs having a tang slidable within each of said brackets and engageable in a snap-fit over a top portion of each of said brackets, whereby pushing against the other of said end portions of said door will cause said beam to flex and said second ridge to slide relative to said door such that said first ridge will be dislodged from its respective pocket enabling said door to be removed.

7. The door assembly of claim 6, wherein said door includes guide tracks formed in side portions and a central portion thereof.

8. The door assembly of claim 7, wherein said second ridge includes side rails slidable along said side portions of said guide tracks and a pair of central tongues slidable in said central portion of said guide track.

9. The door assembly of claim 6, wherein each of said brackets is L-shaped in cross-section.

* * * * *